US007914593B2

(12) United States Patent
Hirose et al.

(10) Patent No.: US 7,914,593 B2
(45) Date of Patent: Mar. 29, 2011

(54) FUEL COMPOSITION

(75) Inventors: Masanori Hirose, Yokohama (JP); Hideshi Iki, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 361 days.

(21) Appl. No.: 12/294,110

(22) PCT Filed: Feb. 22, 2007

(86) PCT No.: PCT/JP2007/053860

§ 371 (c)(1), (2), (4) Date: Sep. 23, 2008

(87) PCT Pub. No.: WO2007/113960

PCT Pub. Date: Oct. 11, 2007

(65) Prior Publication Data

US 2009/0126264 A1 May 21, 2009

(30) Foreign Application Priority Data

Mar. 31, 2006 (JP) ..... 2006-099603

(51) Int. Cl.
*C10L 1/10* (2006.01)

(52) U.S. Cl. ..... 44/300; 585/14

(58) Field of Classification Search ..... 44/300; 585/14

See application file for complete search history.

(56) References Cited

U.S. PATENT DOCUMENTS

| | | | | |
|---|---|---|---|---|
| 6,663,767 | B1 * | 12/2003 | Berlowitz et al. | 208/15 |
| 2004/0128905 | A1 | 7/2004 | Clark et al. | |
| 2004/0152930 | A1 | 8/2004 | O'Rear et al. | |

FOREIGN PATENT DOCUMENTS

| | | | |
|---|---|---|---|
| JP | 2003-105354 | A | 4/2003 |
| JP | 2003-531950 | A | 10/2003 |
| JP | 2004-067905 | A | 3/2004 |
| JP | 2005-002229 | A | 1/2005 |
| JP | 2005-529213 | A | 9/2005 |
| JP | 2005-538204 | A | 12/2005 |
| WO | 01/83648 | A2 | 11/2001 |
| WO | 03044134 | A2 | 5/2003 |
| WO | 03091364 | A2 | 11/2003 |
| WO | 03/104361 | A2 | 12/2003 |
| WO | 2004-022674 | A1 | 3/2004 |
| WO | 2004/069964 | A2 | 8/2004 |

OTHER PUBLICATIONS

O'Rear. Dennis J. et al; "Thermally Stable blends of Fischer Tropsch and LCO Diesel Fuel Components"; Energy and Fuels; vol. 18(3); pp. 682-684; (2004).

Shah, P. P. et al.; "Fischer-tropsch Wax Characterization and Upgrading: Final Report"; DOE Report; (1988).

Yoshifumi Suehiro et al., "IV-B-2, GTL Abura no Upgrading Oyobi Riyo Sokushin Kenkyu," Gijutsu Senta Nenpo Heisei 15 Nendo, Japan Oil Gas and Metals National Corp., pp. 116-117, (2004).

Konishi Seiichi, "Nenryo Kogaku Gairon," Shokabo Publishing Co., Ltd., pp. 136-144, (1991).

U.S. Appl. No. 12/295,308, filed Sep. 30, 2008.

U.S. Appl. No. 12/302,675, filed Nov. 26, 2008.

Database WPI Week 200609, Thomson Scientific, London (2006) Abstract only.

EP Suppl. Search Report issued Oct. 19, 2010 in EP Application No. 07 73 8757.

* cited by examiner

*Primary Examiner* — Cephia D Toomer

(74) *Attorney, Agent, or Firm* — Panitch Schwarze Belisario & Nadel LLP

(57) ABSTRACT

The present invention provides a fuel composition capable of suppressing reduction of fuel consumption, maintaining the excellent exhaust gas properties of a Fischer-Tropsch synthetic oil. The fuel composition comprises a Fischer-Tropsch synthetic oil and a petroleum-based hydrocarbon mixture A having the following properties (1) to (5) in an amount of 10 to 30 percent by volume on the basis of the total mass of the composition: (1) 15° C. density: 800 Kg/cm$^3$ or greater and 900 Kg/m$^3$ or less; (2) 10 volume % distillation temperature (T10): 150° C. or higher and 200° C. or lower; (3) 97 volume % distillation temperature (T97): 270° C. or lower; (4) aromatic content: 40 percent by volume or more and 70 percent by volume or less; and (5) sulfur content: 30 ppm by mass or less.

3 Claims, No Drawings

FUEL COMPOSITION

CROSS-REFERENCE TO RELATED APPLICATION

This application is a Section 371 of International Application No. PCT/JP2007/053860, filed Feb. 22, 2007, which was published in the Japanese language on Oct. 11, 2007, under International Publication No. WO 2007/113960 A1, and the disclosure of which is incorporated herein by reference.

FIELD OF THE INVENTION

The present invention relates to fuel composition used for compression ignition engines and more specifically to fuel compositions which are excellent both in fuel consumption and environment protection properties.

BACKGROUND OF THE INVENTION

Synthetic oils produced through a Fischer-Tropsch reaction are high in cetane number and contain almost no sulfur or aromatic and thus have been highly expected to be used as clean fuel for compression ignition engines. However, the synthetic oils produced through a Fischer-Tropsch reaction are rich in paraffins and smaller in lower heating value per unit volume than the conventional petroleum-based diesel fuels, possibly leading to a reduction in the fuel consumption. There has been no known method for suppressing reduction of the fuel consumption associated with using the Fischer-Tropsch synthetic oil from without adversely affecting the exhaust gas.

DISCLOSURE OF THE INVENTION

The present invention is intended to solve the foregoing problems and has an object to provide a fuel composition by blending therewith a petroleum-based hydrocarbon mixture composition with specific properties so as to suppress the fuel consumption from reducing without adversely affecting the exhaust gas.

As the results of the extensive research and study carried out by the inventors, the present invention has been accomplished on the basis of their finding that blending of a synthetic oil produced through a Fischer-Tropsch reaction with a petroleum-based hydrocarbon mixture with specific properties enables the fuel consumption to suppress from reducing without adversely affecting the exhaust gas.

That is, according to the present invention, there is provided a fuel composition with a flash point of 45° C. or higher, comprising a Fischer-Tropsch synthetic oil and a petroleum-based hydrocarbon mixture A having the following properties (1) to (5) in an amount of 10 to 30 percent by volume on the basis of the total mass of the composition:

(1) 15° C. density: 800 Kg/cm$^3$ or greater and 900 Kg/m$^3$ or less;

(2) 10 volume % distillation temperature (T10): 150° C. or higher and 200° C. or lower;

(3) 97 volume % distillation temperature (T97): 270° C. or lower;

(4) aromatic content: 40 percent by volume or more and 70 percent by volume or less; and (5) sulfur content: 30 ppm by mass or less.

The present invention also relates to the foregoing fuel composition wherein the petroleum-based hydrocarbon mixture A is a fraction produced through a catalytic cracker.

The present invention also relates to the foregoing fuel composition wherein the petroleum-based hydrocarbon mixture A is a fraction produced by hydrodesulfurizing a fraction produced through a catalytic cracker under conditions where the reaction temperature is 250° C. or higher and 310° C. or lower, the hydrogen pressure is 5 MPa or greater and 10 MPa or less, the LHSV is 0.5 h$^{-1}$ or greater and 3.0 h$^{-1}$ or less, and the hydrogen/hydrocarbon volume ratio is 0.15 or greater and 0.6 or less, using a catalyst containing any of Ni—W, Ni—Mo, Co—Mo, Co—W or Ni—Co—Mo.

EFFECTS OF THE INVENTION

The fuel composition of the present invention comprises a Fischer-Tropsch synthetic oil blended with a petroleum-based hydrocarbon with specific properties and thereby can reduce the possibility of a reduction in fuel consumption caused by one of the characteristics of the Fischer-Tropsch synthetic oil that is the lower heating value per unit volume, which value is smaller than those of the conventional petroleum-based diesel fuels, maintaining the excellent exhaust gas properties of the Fischer-Tropsch synthetic oil.

BEST MODE FOR CARRYING OUT THE INVENTION

The present invention will be described in detail below.

The fuel composition of the present invention comprises a Fischer-Tropsch synthetic oil (FT synthetic oil) and a petroleum-based hydrocarbon mixture with specific properties.

The FT synthetic oil referred herein denotes various synthetic oils such as liquid fractions corresponding to naphtha, kerosene and gas oil, produced by subjecting a mixed gas containing mainly hydrogen and carbon monoxide (hereinafter may be often referred to as "synthetic gas") to a Fischer-Tropsch (FT) reaction; hydrocarbon mixtures produced by hydrorefining or hydrocracking such liquid fractions; and hydrocarbon mixtures produced by hydrorefining or hydrocracking liquid fractions and FT wax produced through a Fischer-Tropsch reaction.

The mixed gas which will be the feedstock of the FT synthetic oil is produced by oxidizing a substance containing carbon using oxygen and/or water and/or carbon dioxide and further if necessary by a shift reaction using water so as to be adjusted in predetermined hydrogen and carbon monoxide concentrations.

Substances containing carbon which may be used herein are generally gas components composed of hydrocarbons that are gas in normal temperatures such as natural gas, liquefied petroleum gas, and methane gas, petroleum asphalt, biomass, coke, wastes such as building materials and garbage, sludge, heavy crude oils that are difficult to be disposed in the usual manner, and mixed gas produced by exposing unconventional petroleum resources to elevated temperatures. However, in the present invention, there is no particular restriction on the feedstock as long as a mixed gas containing mainly hydrogen and carbon monoxide can be produced.

The Fischer-Tropsch reaction requires a metal catalyst. It is preferable to use metals in Group 8 of the periodic table, such as cobalt, ruthenium, rhodium, palladium, nickel and iron, more preferably metals in Group 8, Period 4, as an active catalyst component. Alternatively, there may be used a mixed metal group containing these metals in suitable amounts. These active metals are generally used in the form of a catalyst produced by supporting them on a support such as alumina, titania and silica-alumina. Alternatively, the use of the forgoing active metals in combination with a second metal can improve the performances of the resulting catalyst. Examples of the second metal include alkali or alkaline earth metals such as sodium, lithium and magnesium, zirconium, hafnium and titanium, which will be used depending on purposes such as increase in conversion rate of carbon monoxide or chain growth probability ($\alpha$) which is an index of the production amount of wax.

The Fischer-Tropsch reaction is a synthetic method for producing liquid fractions and FT wax using a mixed gas as the feedstock. It is generally preferable to adjust the ratio of hydrogen to carbon monoxide in the mixed gas in order to carry out the synthetic method efficiently. In general, the molar mix ratio of hydrogen to carbon monoxide (hydrogen/carbon monoxide) is preferably 1.2 or greater, more preferably 1.5 or greater, more preferably 1.8 or greater. The ratio is also preferably 3 or less, more preferably 2.6 or less, more preferably 2.2 or less.

The reaction temperature at which the Fischer-Tropsch reaction is carried out using the foregoing catalyst is preferably 180° C. or higher and 320° C. or lower, more preferably 200° C. or higher and 300° C. or lower. At a reaction temperature of lower than 180° C., carbon monoxide hardly reacts, resulting in a tendency that the hydrocarbon yield is reduced. At a reaction temperature of higher than 320° C., gas such as methane is increasingly formed, resulting in a reduction in the production efficiency of liquid fractions and FT wax.

There is no particular restriction on the gas hourly space velocity with respect to the catalyst. However, it is preferably 500 $h^{-1}$ or more and 4000 $h^{1}$ or lower, more preferably 1000 $h^{-1}$ or more and 3000 $h^{-1}$ or lower. A gas hourly space velocity of less than 500 $h^{-1}$ is likely to reduce the production of the liquid fuel while a gas hourly space velocity of more than 400 $h^{-1}$ causes a necessity to increase the reaction temperature and increase the amount of gas to be produced, resulting in a reduction in the yield of the intended product.

There is no particular restriction on the reaction pressure (partial pressure of a synthetic gas composed of carbon monoxide and hydrogen). However, it is preferably 0.5 MPa or greater and 7 MPa or smaller, more preferably 2 MPa or greater and 4 MPa or smaller. If the reaction pressure is smaller than 0.5 MPa, the yield of liquid fuel would tend to decrease. If the reaction pressure is greater than 7 MPa, it is not economically advantageous because the amount of capital investment in facilities would be increased.

If necessary, liquid fractions and FT wax produced through the above-described FT reaction may be hydrorefined or hydrocracked in any suitable manner so as to be adjusted in distillation characteristics or composition to achieve the purposes of the invention. Hydrorefining or hydrocracking may be selected depending on the purposes and the present invention is not limited in selection to either one or both of them to such an extent that the fuel composition of the present invention is produced.

Catalysts used for hydrorefining are generally those comprising a hydrogenation active metal supported on a porous support, but the present invention is not limited thereto as long as the same effects are obtained.

The porous support is preferably an inorganic oxide. Specific examples include alumina, titania, zirconia, boria, silica, zeolite and the like.

Zeolite is crystalline aluminosilicate, examples of which include faujasite, pentasil and mordenite type zeolites. Preferred are faujasite, beta and mordenite type zeolites and particularly preferred are Y-type and beta-type zeolites. Y-type zeolites are preferably ultra stable.

Preferred for the active metal are those of the following two types (active metal A type and active metal B type).

The active metal A type is at least one type of metal selected from the group consisting of those in Group 8 of the periodic table. It is preferably at least one type selected from the group consisting of Ru, Rh, Ir, Pd and Pt, and is more preferably Pd and/or Pt. The active metal may be a combination of these metals, such as Pt—Pd, Pt—Rh, Pt—Ru, Ir—Pd, Ir—Rh, Ir—Ru, Pt—Pd—Rh, Pt—Rh—Ru, Ir—Pd—Rh, and Ir—Rh—Ru. A noble metal catalyst formed of these metals can be used after being subjected to a pre-reduction treatment under hydrogen flow. In general, the catalyst is heated at a temperature of 200° C. or higher in accordance with predetermined procedures, circulating a gas containing hydrogen so that the active metal on the catalyst is reduced and thus exhibits hydrogenation activity.

The active metal B type contains preferably at one type of metal selected from the group consisting of those in Groups 6A and 8 of the periodic table, desirously two or more types of metals selected therefrom. Examples of these metals include Co—Mo, Ni—Mo, Ni—Co—Mo and Ni—W. When a metal sulfide catalyst formed of these metals is used, it must undergo a pre-sulfurization process.

The metal source may be a conventional inorganic salt or complex salt compound. The supporting method may be any supporting method that has been usually used for hydrogenation catalysts, such as impregnation and ion-exchange methods. When a plurality of metals are supported, they may be supported simultaneously using a mixed solution thereof or sequentially using a single solution containing each metal. The metal solution may be an aqueous solution or a solution using an organic solvent.

The reaction temperature at which hydrorefining is carried out using a catalyst composed of the active metal A type is preferably 180° C. or higher and 400° C. or lower, more preferably 200° C. or higher and 370° C. or lower, more preferably 250° C. or higher and 350° C. or lower, more preferably 280° C. or higher and 350° C. or lower. A reaction temperature of higher than 370° C. is not preferable because the yield of the middle fraction is extremely reduced, resulting from an increase in a side reaction wherein the liquid fraction or FT wax is cracked to a naphtha fraction. A reaction temperature of lower than 270° C. is not also preferable because alcohols can not be removed and thus remains in the reaction system.

The reaction temperature at which hydrorefining is carried out using a catalyst composed of the active metal B type is preferably 170° C. or higher and 320° C. or lower, more preferably 175° C. or higher and 300° C. or lower, more preferably 180° C. or higher and 280° C. or lower. A reaction temperature of higher than 320° C. is not preferable because the yield of the middle fraction is reduced, resulting from an increase in a side reaction wherein the liquid fraction or FT wax is cracked to a naphtha fraction. A reaction temperature of lower than 170° C. is not also preferable because alcohols can not removed and thus remains in the reaction system.

The hydrogen pressure at which hydrorefining is carried out using a catalyst composed of the active metal A type is preferably 0.5 MPa or greater and 12 MPa or less, more preferably 1.0 MPa or greater and 5.0 MPa or less. Although a higher hydrogen pressure facilitates the hydrogenation reaction, there is generally an optimum point in economical sense.

The hydrogen pressure at which hydrorefining is carried out using a catalyst composed of the active metal B type is preferably 2 MPa or greater and 10 MPa or less, more preferably 2.5 MPa or greater and 8 MPa or less, more preferably 3 MPa or greater and 7 MPa or less. Although a higher hydrogen pressure facilitates the hydrogenation reaction, there is generally an optimum point in economical sense.

The liquid hourly space velocity (LHSV) at which hydrorefining is carried out using a catalyst composed of the active metal A type is preferably 0.1 $h^{-1}$ or greater and 10.0 $h^{-1}$ or less, more preferably 0.3 $h^{-1}$ or greater and 3.5 $h^{-1}$ or less. Although a lower LHSV is advantageous for the reaction, a too low LHSV is not economically preferable because it requires an extremely large reactor volume, leading to an excessive capital investment in facilities.

The liquid hourly space velocity (LHSV) at which hydrorefining is carried out using a catalyst composed of the active metal B type is preferably 0.1 $h^{-1}$ or greater and 2 $h^{-1}$ or less, more preferably 0.2 $h^{-1}$ or greater and 1.5 $h^{-1}$ or less, more preferably 0.3 $h^{-1}$ or greater and 1.2 $h^{-1}$ or less. Although a lower LHSV is advantageous for the reaction, a too low LHSV is not economically preferable because it requires an extremely large reactor volume, leading to an excessive capital investment in facilities.

The hydrogen/oil ratio at which hydrorefining is carried out using a catalyst composed of the active metal A type is preferably 50 NL/L or greater and 1000 NL/L or less, more preferably 70 NL/L or greater and 800 NL/L or less. Although a higher hydrogen/oil ratio facilitates the reaction, there is generally an optimum point in economical sense.

The hydrogen/oil ratio at which hydrorefining is carried out using a catalyst composed of the active metal B type is preferably 100 NL/L or greater and 800 NL/L or less, more preferably 120 NL/L or greater and 600 NL/L or less, more preferably 150 NL/L or greater and 500 NL/L or less. Although a higher hydrogen/oil ratio facilitates the reaction, there is generally an optimum point in economical sense.

Catalysts used for hydrocracking are generally those comprising a hydrogenation active metal supported on a support with solid acidic properties, but the present invention is not limited thereto as long as the same effects are obtained.

As for the support with solid acidic properties, there are amorphous and crystalline zeolite types. Specific examples include silica-alumina, silica-magnesia, silica-zirconia and silica-titania, which are of amorphous type and zeolites of faujasite, beta, MFI and mordenite types, preferably Y type and beta type. The Y type zeolites are preferably those that are ultra stable.

Preferred for the active metal are those of the following two types (active metal A type and active metal B type).

The active metal A type is at least one type of metal mainly selected from the group consisting of those in Groups 6A and 8 in the periodic table. It is preferably at least one type of metal selected from the group consisting of Ni, Co, Mo, Pt, Pd and W. A noble metal catalyst formed of these metals can be used after being subjected to a pre-reduction treatment under hydrogen flow. In general, the catalyst is heated at a temperature of 200° C. or higher in accordance with predetermined procedures, circulating a gas containing hydrogen so that the active metal on the catalyst is reduced and thus exhibits hydrogenation activity.

The active metal B type may be a combination of these metals, such as Pt—Pd, Co—Mo, Ni—Mo, Ni—W, and Ni—Co—Mo. When a catalyst formed of these metals is used, it must undergo a pre-sulfurization process before use.

The metal source may be a conventional inorganic salt or complex salt compound. The supporting method may be any supporting method that has been usually used for hydrogenation catalysts, such as impregnation and ion-exchange methods. When a plurality of metals are supported, they may be supported simultaneously using a mixed solution thereof or sequentially using a single solution containing each metal. The metal solution may be an aqueous solution or a solution with an organic solvent.

The reaction temperature at which hydrocracking is carried out using a catalyst composed of the active metal type A and active metal type B is preferably 200° C. or higher and 450° C. or lower, more preferably 250° C. or higher and 430° C. or lower, more preferably 300° C. or higher and 400° C. or lower. A reaction temperature of higher than 450° C. is not preferable because the yield of the middle fraction is extremely reduced, resulting from an increase in a side reaction wherein the liquid fraction or FT wax is cracked to a naphtha fraction. A reaction temperature of lower than 200° C. is not also preferable because the activity of the catalyst is extremely reduced.

The hydrogen pressure at which hydrocracking is carried out using a catalyst composed of the active metal type A and active metal type B is preferably 1 MPa or greater and 20 MPa or less, more preferably 4 MPa or greater and 16 MPa or less, more preferably 6 MPa or greater and 13 MPa or less. Although a higher hydrogen pressure facilitate the hydrogenation reaction, the cracking reaction would rather proceed slowly and thus needs to be adjusted in the proceeding thereof by increasing the reaction temperature, leading to a short working life of the catalyst. Therefore, there is generally an optimum point in economical sense.

The liquid hourly space velocity (LHSV) at which hydrocracking is carried out using a catalyst composed of the active metal A type is preferably 0.1 $h^{-1}$ or greater and 10.0 $h^{-1}$ or less, more preferably 0.3 $h^{-1}$ or greater and 3.5 $h^{-1}$ or less. Although a lower LHSV is advantageous for the reaction, a too low LHSV is not economically preferable because it requires an extremely large reactor volume, leading to an excessive capital investment in facilities.

The liquid hourly space velocity (LHSV) at which hydrocracking is carried out using a catalyst composed of the active metal B type is preferably 0.1 $h^{-1}$ or greater and 2 $h^{-1}$ or less, more preferably 0.2 $h^{-1}$ or greater and 1.7 $h^{-1}$ or less, more preferably 0.3 $h^{-1}$ or greater and 1.5 $h^{-1}$ or less. Although a lower LHSV is advantageous for the reaction, a too low LHSV is not economically preferable because it requires an extremely large reactor volume, leading to an excessive capital investment in facilities.

The hydrogen/oil ratio at which hydrocracking is carried out using a catalyst composed of the active metal A type is preferably 50 NL/L or greater and 1000 NL/L or less, more preferably 70 NL/L or greater and 800 NL/L or less, more preferably 400 NL/L or greater and 1500 NL/L or less. Although a higher hydrogen/oil ratio facilitates the reaction, there is generally an optimum point in economical sense.

The hydrogen/oil ratio at which hydrocracking is carried out using a catalyst composed of the active metal B type is preferably 150 NL/L or greater and 2000 NL/L or less, more preferably 300 NL/L or greater and 1700 NL/L or less, more preferably 400 NL/L or greater and 1500 NL/L or less. Although a higher hydrogen/oil ratio facilitates the reaction, there is generally an optimum point in economical sense.

The reactor for hydrogenation may be of any structure and a single or a plurality of reaction tower may be used. Hydrogen may be additionally supplied between a plurality of reaction towers. The reactor may have a facility for removing sulfurized hydrogen and a distillation tower for fractionally distilling hydrogenated products for producing desired fractions.

The reaction mode of the hydrogenation reactor may be a fixed bed mode. Hydrogen may be supplied to the feedstock in a counter or parallel flow mode. Alternatively, the reaction mode may be a combination of counter and parallel flow modes, with a plurality of reaction towers. The supply mode of the feedstock is generally down flow and is preferably a gas-liquid cocurrent flow mode. Hydrogen gas may be supplied as quencher into a middle portion of a reactor for the purposes of removing the reaction heat or increasing the hydrogen partial pressure.

The fuel composition of the present invention is a composition with a flash point of 45° C. or higher, comprising the above-described Fischer-Tropsch synthetic oil and a petroleum-based hydrocarbon mixture A with the following properties (1) to (5), in an amount of 10 to 30 percent by volume, on the basis of the total mass of the composition:

(1) 15° C. density: 800 Kg/cm$^3$ or greater and 900 Kg/m$^3$ or less;

(2) 10 volume % distillation temperature (T10): 150° C. or higher and 200° C. or lower;

(3) 97 volume % distillation temperature (T97): 270° C. or lower;

(4) aromatic content: 40 percent by volume or more and 70 percent by volume or less; and (5) sulfur content: 30 percent by ppm or less.

The density used herein denotes the density measured in accordance with JIS K 2249 "Crude petroleum and petroleum products-Determination of density and petroleum measurement tables based on a reference temperature (15° C.). The 10% distillation temperature and 97% distillation temperature used herein denote the values measured in accordance with JIS K 2254 "Petroleum products-Determination of distillation characteristics". The aromatic content used herein denotes the value measured in accordance with the fluorescent indicator adsorption method of JIS K 2536, "Liquid petroleum products-Testing method of components".

The content of the petroleum-based hydrocarbon mixture A is necessarily 10 percent by volume or more, preferably 12 percent by volume or more, more preferably 15 percent by volume or more, on the basis of the total mass of the composition. A content of the petroleum-based hydrocarbon mixture A of less than 10 percent by volume is not preferable because the resulting fuel would fail to exhibit sufficiently a fuel consumption improving effect. The content of the petroleum-based hydrocarbon mixture A is necessarily 30 percent by volume or less, preferably 28 percent by volume or less, more preferably 25 percent by volume or less, on the basis of the total mass of the composition. A content of the petroleum-based hydrocarbon mixture A of more than 30 percent by volume is not preferable because the exhaust gas would be adversely affected.

The petroleum-based hydrocarbon mixture A of the fuel composition of the present invention is preferably a fraction produced through a catalytic cracker.

The catalytic cracker referred herein denotes a unit for producing a gasoline base material with a high octane number by catalytically cracking a fraction with a boiling point higher than gas oil, in the presence of a solid catalyst, which is generally an amorphous silica-alumina catalyst or a zeolite catalyst. The catalytic cracker is essentially composed of a reactor and a catalyst regenerator. The reaction conditions are those wherein the reactor temperature is from 470 to 550° C., the regenerator temperature is from 650 to 750° C., the reactor pressure is from 0.08 to 0.15 MPa, and the regenerator pressure is from 0.09 to 0.2 MPa. Examples of the catalytic cracking processes include air-lift thermophore, Houdriflow, UOP, Shell 2-stage, Flexicracking, Orthoflow, Texaco, Gulf, ultracat cracking, Arco cracking, HOC, and RCC methods. However, in the present invention, there is no particular restriction on the process or operation conditions of the catalytic cracker. Therefore, any conventional catalytic cracker may be used.

Alternatively, the petroleum-based hydrocarbon mixture A of the fuel composition of the present invention is preferably a fraction produced by hydrodesulfurizing a fraction produced through a catalytic cracker.

Hydrodesulfurization of a fraction produced through a catalytic cracker is carried out under conditions wherein the reaction temperature is 250° C. or higher and 310° C. or lower, the hydrogen pressure is 5 MPa or greater and 10 MPa or lower, the LHSV is 0.5 h$^{-1}$ or greater and 3.0 h$^{-1}$ or lower, and the hydrogen/hydrocarbon volume ratio is 0.15 or greater and 0.6 or less, using a catalyst containing any one of Ni—W, Ni—Mo, Co—Mo, Co—W or Ni—Co—Mo.

The sulfur content of the fuel composition of the present invention is preferably 10 ppm by mass with the objective of reducing the amount of harmful exhaust gas discharged from an engine and improving the performance of an exhaust-gas post-treatment device. The sulfur content referred herein denotes the value measured in accordance with JIS K 2541 "Crude oil and petroleum products-Determination of sulfur content".

The kinematic viscosity at 30° C. of the fuel composition of the present invention is preferably 1.6 mm$^2$/s or greater, more preferably 1.65 mm$^2$/s or greater. When the kinematic viscosity is less than 1.6 mm$^2$/s, it would be difficult to control the timing of the fuel injection at a fuel injection pump side and to diminish lubricity at each part of the fuel injection pump equipped in an engine. Whereas, the upper limit of the kinematic viscosity at 30° C. is preferably 5.0 mm$^2$/s or less, more preferably 4 mm$^2$/s or less. When the kinematic viscosity is in excess of 5.0 mm$^2$/s, a fuel injection system is destabilized due to an increase in resistance therein and thus the NOx and PM concentrations in the exhaust gas are increased. The kinematic viscosity referred herein denotes the kinematic viscosity measured in accordance with JIS K 2283 "Crude petroleum and petroleum products-Determination of kinematic viscosity and calculation of viscosity index from kinematic viscosity".

The fuel composition of the present invention preferably exhibits neutrality as the result of a reaction test. When the test result is not neutral, it would increase the possibility that corrosion effect to metal parts caused by the resulting fuel would be significant. The reaction test result referred herein denotes the value measured in accordance with JIS K 2252 "Petroleum Products-Testing Method for Reaction".

The corrosiveness to copper of the fuel composition of the present invention is preferably 1 or less, more preferably 1a. If the corrosiveness to copper is not 1 or less, it would increase the possibility that corrosion effect to metal parts caused by the resulting fuel would be significant and thus problems related to stability or long storage would arise. The corrosiveness to copper referred herein denotes the value measured in accordance with JIS K 2513 "Petroleum products-Corrosiveness to copper-copper strip test".

The flash point of the fuel composition of the present invention is preferably 45° C. or higher. A flash point of lower than 45° C. is not preferable in view of safety. Therefore, the flash point is preferably 47° C. or higher, more preferably 49° C. or higher. The flash point referred herein denotes the value measured in accordance with JIS K 2265 "Crude oil and petroleum products-Determination of flash point".

The carbon residue in the 10% distillation residue of the fuel composition of the present invention is preferably 0.1 percent by mass or less, more preferably 0.05 percent by mass or less with the objective of inhibiting a filter from clogging with sludge. The carbon residue in the 10% distillation residue used herein denotes the value measured in accordance with JIS K 2270 "Crude petroleum and petroleum products-Determination of carbon residue"

If necessary, the fuel composition of the present invention is preferably blended with a cold flow improver, a lubricity improves and other additives in suitable amounts.

The fuel composition of the present invention may be blended with a cold flow improver depending on the temperature of the environment where the composition is used. The amount of the cold flow improver to be blended is preferably 50 mg/L or more and 1000 mg/L or less, more preferably 100 mg/L or more and 800 mg/L or less in terms of the active component concentration.

There is no particular restriction on the cold flow improver, which, therefore, may be one or more types of cold flow improvers, including ethylene-unsaturated ester copolymers such as ethylene-vinyl acetate copolymers; alkenyl succinic acid amides; linear compounds such as dibehenic acid esters of polyethylene glycols; polar nitrogen compounds composed of reactions products of acids such as phthalic acid, ethylenediaminetetraacetic acid and nitriloacetic acid or acid anhydride thereof and hydrocarbyl-substituted amines; and comb polymers composed of alkyl fumarates- or alkyl itaconates-unsaturated ester copolymers. Among these cold flow improvers, preferred are ethylene-vinyl acetate copolymer additives because they can be used for multi-purposes. Since commercially available products referred to as cold flow improvers are often in the form in which the active components contributing to the low temperature fluidity (active components) are diluted with a suitable solvent. Therefore, the above amount of the cold flow improvers denotes the amount of the active components (active component concentration) when such commercially available products are added to the fuel composition of the present invention.

The fuel composition of the present invention is preferably blended with a lubricity improver with the objective of preventing a fuel injection pump from wearing. The amount of the lubricity improver is preferably 20 mg/L or more and 200 mg/L or less, more preferably 50 mg/L or more and 180 mg/L or less, in terms of the active component concentration. When the lubricity improver is blended in an amount within these ranges, the lubricity improver can effectively perform its efficacy thereof. For example, in a diesel engine equipped with a distribution type injection pump, the lubricity improver can suppress the driving torque from increasing and can reduce wear on each part of the pump while the engine is driven.

The lubricity improver may be, but not limited to, any one or more selected from carboxylic acid-, ester-, alcohol- and phenol-based lubricity improvers. Among these lubricity improvers, preferred are carboxylic acid- and ester-based lubricity improvers.

The carboxylic acid-based lubricity improver may be linoleic acid, oleic acid, salicylic acid, palmitic acid, myristic acid or hexadecenoic acid or a mixture of two or more of these carboxylic acids.

Examples of the ester-based lubricity improver include carboxylic acid esters of glycerin. The carboxylic acid forming the carboxylic acid ester may be of one or more types. Specific examples of the carboxylic acid include linoleic acid, oleic acid, salicylic acid, palmitic acid, myristic acid and hexadecenoic acid.

In order to further enhance the properties of the fuel composition of the present invention, other known fuel oil additives (hereinafter referred to as "other additives" for convenience) described below may be added alone or in combination. Examples of other additives include cetane number improvers such as nitric acid esters including alkylnitrates having 6 to 8 carbon atoms and organic peroxides; detergents such as imide compounds, alkenyl succinimides, succinic acid esters, copolymerized polymers and ashless dispersants; phenolic and aminic anti-oxidants; metal deactivators such as salicyliden derivatives; anti-corrosion agents such as aliphatic amines and alkenyl succinic acid esters; anti-static additives such as anionic, cationic, and amphoteric surface active agents; coloring agents such as azo dye; and silicone-based defoaming agents.

The amounts of other additives may be arbitrarily selected. However, the amount of each of other additives is preferably 0.5 percent by mass or less, more preferably 0.2 percent by mass or less, on the basis of the total mass of the composition.

APPLICABILITY IN THE INDUSTRY

According to the present invention, there is provided a fuel composition capable of suppressing the reduction of fuel consumption, maintaining the excellent exhaust gas properties of a Fischer-Tropsch synthetic oil.

EXAMPLES

Hereinafter, the present invention will be described in more details by way of the following examples and comparative examples, which should not be construed as limiting the scope of the invention.

Examples 1 and 2, and Comparative Examples 1 to 3

As set forth in Table 1 below, the fuel composition of Examples 1 and 2 were prepared using a petroleum hydrocarbon mixture A (referred to as "base material A" in Table 1) and a gas oil fraction of a Fischer-Tropsch synthetic oil (referred to as "GTL gas oil" in Table 1) according to the present invention.

The fuel composition of Example 1 was prepared by mixing 15 percent by volume of the base material A and 85 percent by volume of the GTL gas oil, set forth in Table 1.

The fuel composition of Example 2 was prepared by mixing 25 percent by volume of the base material A and 75 percent by volume of the GTL gas oil, set forth in Table 1.

The GTL gas oil and a commercially available No. 2 gas oil were used as Comparative Examples 1 and 2, respectively. As set forth in Table 1, the fuel composition of Comparative Example 3 was prepared by mixing 85 percent by volume of the GTL gas oil and 15 percent by volume of a light cycle oil produced through a catalytic cracker (referred to as "LCO" in the table).

The properties of the fuel compositions of Examples and Comparative Examples are each set forth in Table 2.

Characteristics of the fuels are measured in the following manners.

The density used herein denotes the density measured in accordance with JIS K 2249 "Crude petroleum and petroleum products-Determination of density and petroleum measurement tables based on a reference temperature (15° C.)".

The kinematic viscosity used herein denotes the kinematic viscosity measured in accordance with JIS K 2283 "Crude petroleum and petroleum products-Determination of kinematic viscosity and calculation of viscosity index from kinematic viscosity".

The flash point used herein denotes the value measured in accordance with JIS K 2265 "Crude oil and petroleum products-Determination of flash point".

The sulfur content used herein denotes the content by mass on the basis of the total mass of the gas oil composition, measured in accordance with JIS K 2541 "Crude oil and petroleum products-Determination of sulfur content".

The distillation characteristics used herein denotes the values measured in accordance with JIS K 2254 "Petroleum products-Determination of distillation characteristics".

The aromatic content used herein denotes the volume percentage (volume %) of the aromatic component content measured in accordance with JPI-5S-49-97 Petroleum Products—Determination of Hydrocarbon Types—High Performance Liquid Chromatography" prescribed in JPI Standard and Manuals Testing Method for Petroleum Products published by Japan Petroleum Inst.

The reaction used herein denotes the reaction measured in accordance with JIS K 2252 "Petroleum Products-Testing Method for Reaction".

The corrosiveness to copper used herein denotes the classification of corrosiveness measured in accordance with JIS K 2513 "Petroleum products-Corrosiveness to copper-copper strip test".

(Vehicle Exhaust Gas Test)

Fuel consumption and exhaust gas were measured using a diesel engine-equipped vehicle (Vehicle 1) described below. The tests using the vehicle were carried out in accordance with Exhibit 27 "10/15 Mode Exhaust Emissions Test procedure for Diesel-Powered Motor Vehicles" in "Traffic Safety Nuisance Research Institute's Automobile Type Approval Test Standard" supervised by Ministry of Land, Infrastructure, and Transport Japan. With regard to the fuel consumption, the running distance per unit volume in Comparative Example 1 was defined as 100, which was then compared with the results of the other examples to be quantified. With regard to the values concerning exhaust gas properties, the test result in Comparative Example was defined as 100, which was then compared with the results of the other examples to be quantified. The results of the fuel consumption and exhaust gas are set forth in Table 2.

(Vehicle Specifications): Vehicle 1

Type of engine: in-line 4 cylinder diesel engine with an intercooled supercharger Displacement: 3 L Compression ratio: 18.5

Maximum power: 125 kW/3400 rpm

Maximum torque: 350 Nm/2400 rpm

Adopted regulation: 1997 Exhaust Gas Emission Regulation

Vehicle weight: 1900 kg

Transmission: 4-speed automatic transmission

Exhaust post-processing system: oxidation catalyst

It is confirmed from the results set forth in Table 2 that the use of the fuel compositions of Examples 1 and 2, according to the present invention can improve the fuel consumption without adversely affecting the exhaust gas properties of the gas oil fraction of the Fischer-Tropsch synthetic oil. Whereas, the fuel compositions of Comparative Examples 1 to 3 were poor in fuel consumption or exhaust gas properties, indicating the possibility that the burden on the environment would increase.

TABLE 1

| | | | Base Material A | GTL Gas Oil | Commercially Available No. 2 Gas Oil | LCO |
|---|---|---|---|---|---|---|
| Distillation Characteristics | IBP | ° C. | 152.0 | 159.5 | 157.5 | 167.5 |
| | T10 | ° C. | 167.0 | 183.5 | 182.0 | 189.0 |
| | T30 | ° C. | 172.5 | 214.0 | 242.2 | 208.5 |
| | T50 | ° C. | 181.0 | 248.5 | 277.0 | 236.5 |
| | T90 | ° C. | 194.0 | 314.0 | 338.5 | 315.5 |
| | T97 | ° C. | 198.0 | 329.5 | 359.0 | 334.5 |
| | EP | ° C. | 216.0 | 334.0 | 364.0 | 344.5 |
| Density | @15° C. | $kg/m^3$ | 828 | 768 | 820 | 894 |
| Sulfur Content | | mass ppm | 27 | 1 | 9 | 120 |
| Composition | Total Aromatic Content | vol. % | 53.4 | 0.1 | 17.7 | 66.0 |
| Flash Point | | ° C. | 45 | 56 | 54 | 66 |

TABLE 2

| | | | Example 1 | Example 2 | Comparative Example 1 | Comparative Example 2 | Comparative Example 3 |
|---|---|---|---|---|---|---|---|
| Blend Ratio (vol. %) | Base Material A | | 15 | 25 | | | |
| | GTL Gas Oil | | 85 | 75 | 100 | | 85 |
| | Commercially Available No. 2 Gas Oil | | | | | 100 | |
| | LCO | | | | | | 15 |
| Density | @15° C. | $kg/m^3$ | 777 | 783 | 768 | 820 | 786 |
| Flash Point | | ° C. | 51 | 48 | 56 | 54 | 58 |
| Sulfur Content | | mass ppm | 5 | 8 | 1 | 9 | 19 |
| Kinematic Viscosity | @30° C. | $mm^2/s$ | 1.98 | 1.79 | 2.34 | 3.10 | 2.31 |
| Distillation Characteristics | T10 | ° C. | 182.0 | 180.0 | 183.5 | 182.0 | 185.0 |
| | T50 | | 239.0 | 232.0 | 248.5 | 277.0 | 247.0 |
| | T90 | ° C. | 296.0 | 284.0 | 314.0 | 338.5 | 314.0 |
| Composition | Total Aromatic Content | vol. % | 8.1 | 13.4 | 0.1 | 17.7 | 10.0 |
| Reaction | | | neutral | neutral | neutral | neutral | neutral |
| Corrosiveness to Copper | | | 1a | 1a | 1a | 1a | 1a |
| Carbon residue of 10% distillation residue | | mass % | 0.00 | 0.00 | 0.00 | 0.01 | 0.01 |
| Fuel Consumption Test | | | 103 | 104 | 100 | 105 | 101 |

TABLE 2-continued

| | | Example 1 | Example 2 | Comparative Example 1 | Comparative Example 2 | Comparative Example 3 |
|---|---|---|---|---|---|---|
| Exhaust Gas Test Results | NOx | 100 | 100 | 100 | 105 | 104 |
| | PM | 98 | 97 | 100 | 110 | 116 |

The invention claimed is:

1. A fuel composition with a flash point of 45° C. or higher, comprising a Fischer-Tropsch synthetic oil and a petroleum-based hydrocarbon mixture A having the following properties (1) to (5) in an amount of 10 to 30 percent by volume on the basis of the total mass of the composition:

(1) 15° C. density: 800 Kg/cm$^3$ or greater and 900 Kg/m$^3$ or less;

(2) 10 volume % distillation temperature (T10): 150° C. or higher and 200° C. or lower;

(3) 97 volume % distillation temperature (T97): 270° C. or lower;

(4) aromatic content: 40 percent by volume or more and 70 percent by volume or less; and (5) sulfur content: 30 ppm by mass or less.

2. The fuel composition according to claim 1, wherein the petroleum-based hydrocarbon mixture A is a fraction produced through a catalytic cracker.

3. The fuel composition according to claim 1, wherein the petroleum-based hydrocarbon mixture A is a fraction produced by hydrodesulfurizing a fraction produced through a catalytic cracker under conditions where the reaction temperature is 250° C. or higher and 310° C. or lower, the hydrogen pressure is 5 MPa or greater and 10 MPa or less, the LHSV is 0.5 h$^{-1}$ or greater and h$^{-1}$ or less, and the hydrogen/hydrocarbon volume ratio is 0.15 or greater and 0.6 or less, using a catalyst containing any of Ni—W, Ni—Mo, Co—Mo, Co—W or Ni—Co—Mo.

* * * * *